United States Patent [19]

Rayner

[11] Patent Number: 4,542,837

[45] Date of Patent: Sep. 24, 1985

[54] AEROSOL ACTUATOR

[75] Inventor: Adrien P. Rayner, Iver, England

[73] Assignee: Metal Box P.L.C., Reading, England

[21] Appl. No.: 586,819

[22] Filed: Mar. 6, 1984

[30] Foreign Application Priority Data

Mar. 12, 1983 [GB] United Kingdom ..... 8306856

[51] Int. Cl.[4] ..... B65D 83/00

[52] U.S. Cl. ..... 222/402.11; 222/402.13; 74/96; 74/569

[58] Field of Search ..... 222/402.11, 153, 182, 222/402.12, 402.13, 402.15; 74/96, 569, 567; 215/201, 203, 206

[56] References Cited

U.S. PATENT DOCUMENTS 2,762,891 9/1956 Hill et al. ..... 74/567

3,734,353 5/1973 McIlhenny ..... 222/153

*Primary Examiner*—H. Grant Skaggs

*Assistant Examiner*—Andrew Jones

*Attorney, Agent, or Firm*—Burns, Doane, Swecker & Mathis

[57] ABSTRACT

An actuator for an aerosol container having upper and lower rotatable parts which may be rotated between an operative and an inoperative position. When rotated into the operative position, an actuating member is raised by cam action to a position where it engages an arm member, whereby the valve of the aerosol container may be actuated. When rotated to the inoperative position, the actuating member is lowered by cam action to a position where it is flush with the upper rotatable part and does not engage the arm member and whereby the valve of the aerosol container cannot be actuated.

10 Claims, 10 Drawing Figures

AEROSOL ACTUATOR

BACKGROUND OF THE INVENTION

1. Field of the Invention

This invention relates to actuators for aerosol containers, of the kind which are fitted to the containers and which have a movable actuating portion which is depressed to operate the aerosol valve. Such actuators, which are often referred to as "spray-dome" actuators, are to be distinguished from "button" actuators which are fitted to the valve stem of an aerosol container and which are bodily moved with the valve stem for actuation.

2. Description of the Prior Art

It is well known to arrange spray-dome actuators so that they cannot easily be operated by a child. Such child resistance has been provided in various different ways, amongst which is the provision of two parts which are relatively rotatable between a first position in which the actuating portion is immovable or ineffective to achieve actuation, and a second position in which the actuating portion can move and is effective to achieve actuation. However, the arrangements hitherto proposed have suffered from various disadvantages, amongst which are extreme complexity and correspondingly high moulding costs, lack of visual appeal, difficulty of operation even for an adult, and vulnerability to damage or inadvertent operation during transit or at the point of display.

SUMMARY OF THE INVENTION

The present invention seeks to provide an actuator for an aerosol container in which, with suitable arrangement, some or all of the above disadvantages may be avoided or substantially reduced. Accordingly, the invention provides an actuator for an aerosol container, which comprises upper and lower parts rotatable between a first, operative condition and a second, inoperative condition, in the operative condition of which an actuating member of the upper actuator part may be movable and effective to actuate the valve of a said container to which the actuator is fitted and thereby cause aerosol product to issue from the lower actuator part, and in the inoperative condition of which the actuating member is inoperative to cause dispensing, the lower actuator part having a movable member to actuate the valve, and the actuating member being movable to a raised position by cam action of engageable surfaces of the actuator parts when the actuator is operated from its inoperative to its operative condition, the actuating member then being depressable to actuate the aerosol valve through the agency of the said movable member, in the inoperative condition of the actuator the actuating member being in a depressed position and inoperative to move the movable member to actuate the valve.

DETAILED DESCRIPTION

Figure 1:
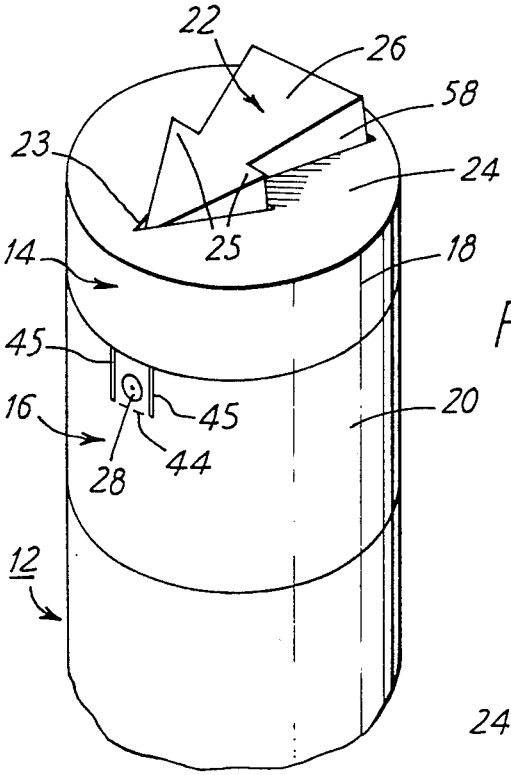
FIG. 1 shows an actuator in accordance with the invention when fitted to the top of an aerosol container, the actuator being seen in perspective view and when in its operative condition, that is to say, when it can be operated.
Figure 2:
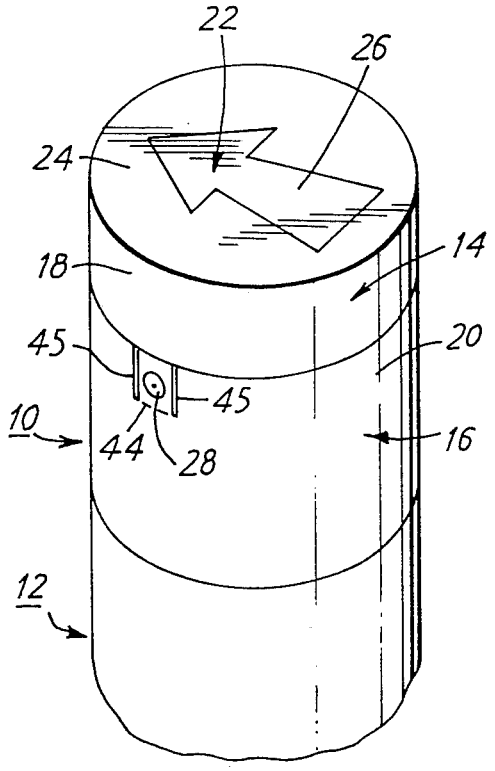
FIG. 2 similarly shows the actuator when in one of its two non-operative conditions.
Figure 3:
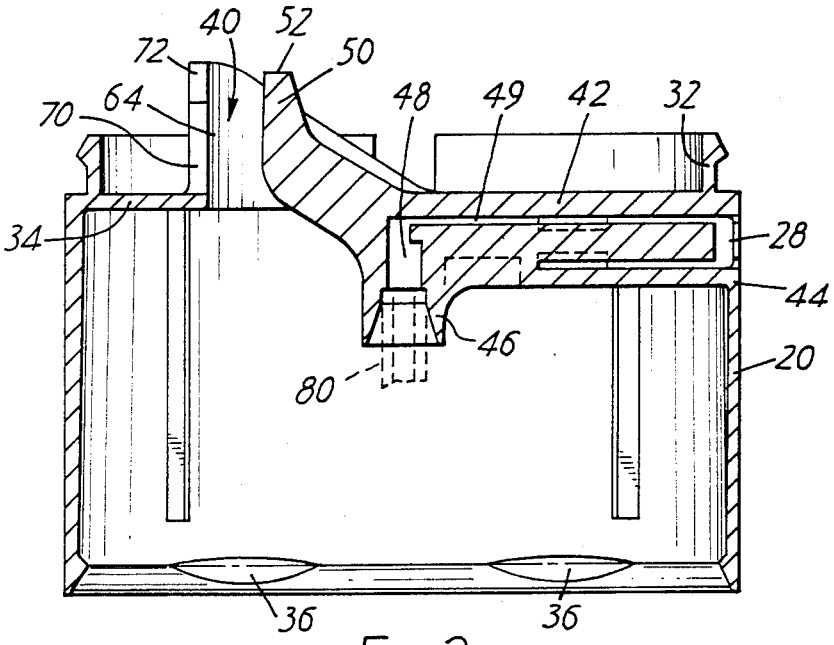
FIG. 3 shows the lower part of the actuator as seen on a diametral plane.
Figure 4:
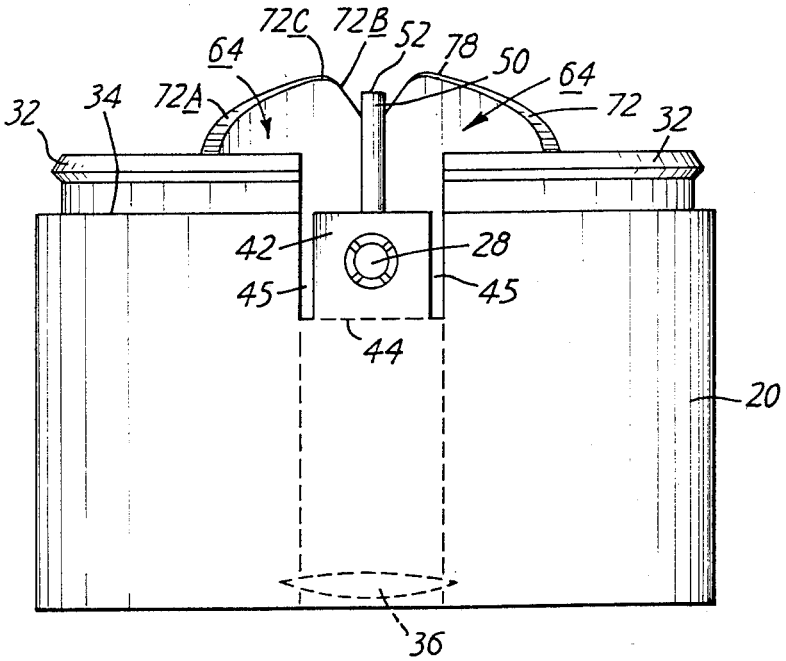
FIG. 4 shows the lower part of the actuator in front elevation.
Figure 5:
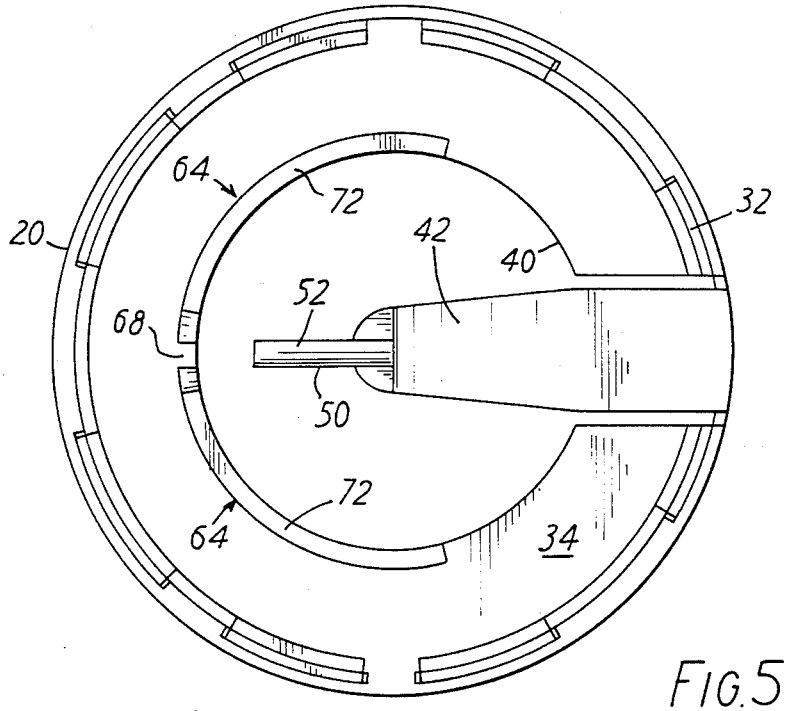
FIG. 5 shows the lower part of the actuator in plan view.
Figure 6:
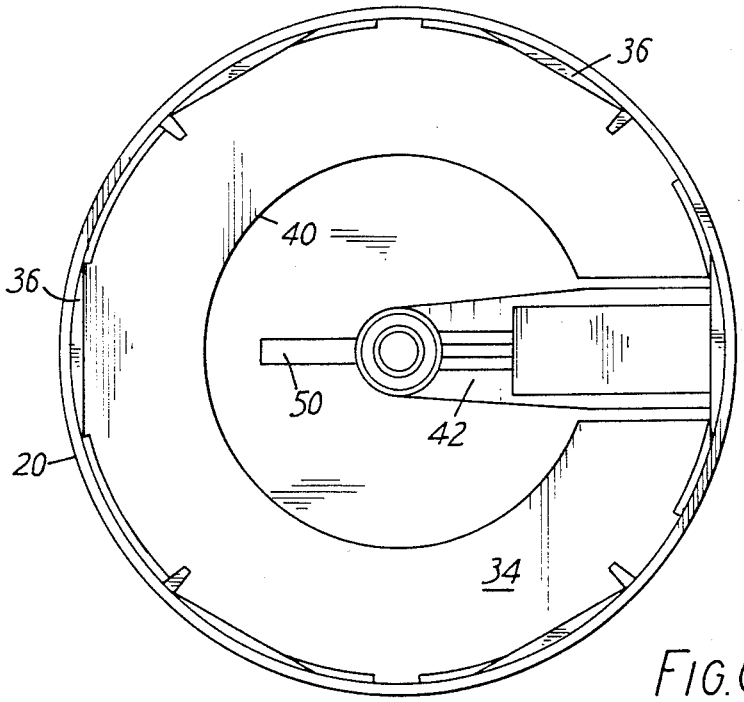
FIG. 6 shows the lower part of the actuator in underplan view.

Referring generally to FIGS. 1 and 2 of the drawings, a spray-dome actuator 10 is shown when fitted to an aerosol container 12—shown only in part—which is of conventional design and construction and accordingly has a valve having an actuating stem 80 (FIG. 3) which projects from the top of the container on the central axis of the container.

The actuator has upper and lower parts 14, 16 which are relatively rotatable through approximately 180° and each of which is a one-piece moulding of high density polyethylene. The parts have equal diameter, coaxially disposed, cylindrical skirts 18, 20 generally flush with the cylindrical periphery of the container 12.

The upper part 14 of the actuator has an arrow-shaped actuating member 22 which is mounted in a correspondingly shaped aperture 23 in its plane top panel 24 and which has barbs denoted 25. When, as depicted in FIG. 1, the actuator is in its operative condition, the actuating member is in a raised position in which it can be depressed by the user by finger pressure on its top face 26. Product is then expelled through a nozzle 28 in the skirt 20 of the lower part 16. It will be seen that at this operative condition the actuating member is aligned with the nozzle.

When, however, the actuator is in a non-operative position as shown in FIG. 2, that is, with the upper part displaced by approximately 90° in either direction from the operative condition of FIG. 1, the actuating member is held flush with the top panel 24 and is immovable against an attempt by a child to dispense product by depressing it further. It is in this condition that the aerosol pack (i.e. the container fitted with the actuator) is dispatched by the packer for distribution and sale.

As will later become apparent, for angles of displacement of the upper part in relation to the lower part lying between O° and approximately 5° from the operative condition, depression of the actuating member 22 will rotate the parts to the operative condition so that dispensing of product results. For angles of displacement lying between approximately 5° and approximately 90°, however, the actuating member will be partially raised, but pressure on it will tend to rotate the parts to the adjacent non-operative condition with lowering of the actuating member to its flush position; even if such rotation does not occur, the actuating member is immovable and no product is dispensed.

It will be understood from the above that the actuating member 22 is aligned with the nozzle 28 for dispensing, but is rotated out of approximate alignment with the nozzle when non-operation (e.g. for transit and display) and child reistance is required. The actuator is therefore readily operable by an adult who may easily preceive that the actuating member needs to be aligned with the nozzle prior to dispensing, but will be more difficult to operate by a young child to whom the need to align the actuating member with the nozzle will be less evident. Moreover, the disposition of the actuating member in flush relation to the top of the actuator when the actuator is in either of its two non-operative conditions prevents damage or inadvertent operation when the container, with the actuator fitted, is in transit or on display; in particular, there is little or no danger of inadvertent actuation when the container is stacked beneath one or more other such containers, on pallets or the like.

Figure 7:
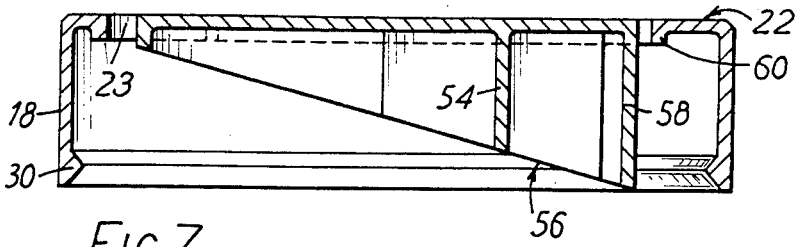
FIG. 7 shows the upper part of the actuator as seen on the same diametral plane as FIG. 3 but looking in the opposite direction.
Figure 8:
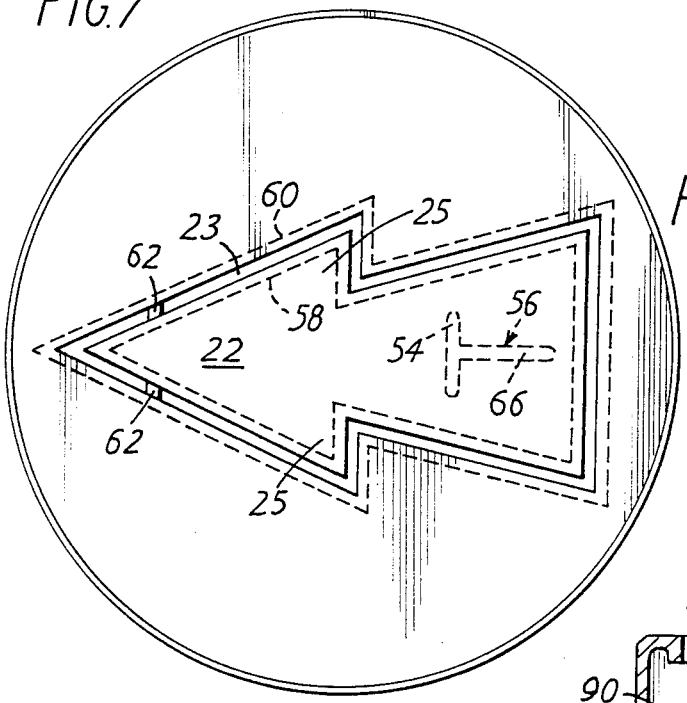
FIG. 8 shows the upper part of the actuator in plan view.
Figure 9:
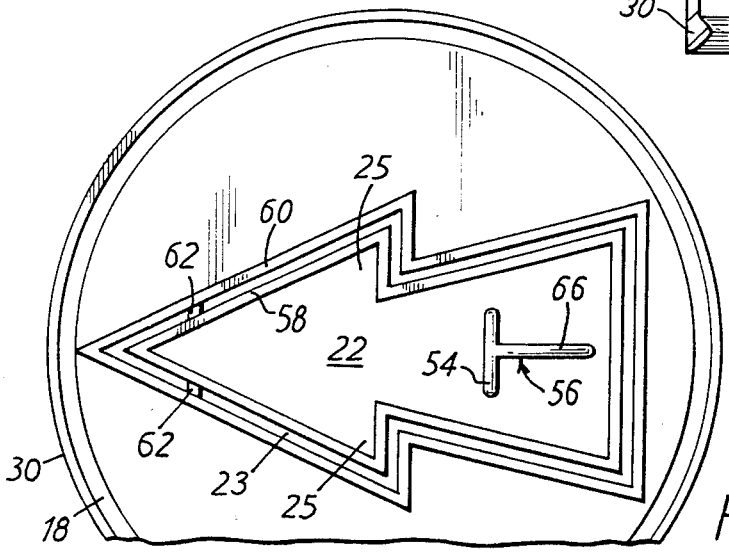
FIG. 9 shows the upper part of the actuator in underplan view.

The arrangement of the actuator and its separate parts will become clear from the description now to be given with reference to FIGS. 3 to 9, of which FIGS. 3 to 6 show the lower part 16 and FIGS. 7 to 9 show the upper part 14.

The upper part 14 is held captive for rotation on the lower part 16 by a bead 30 on its cylindrical skirt 18 which is snap-engaged over a complementary and fragmentary bead 32 carried from a top panel 34 of the lower part above the skirt 20 of the latter. In its turn the lower part has a fragmented bead formed by ribs 36 which are adapted to be snap-engaged over the double-seam (not shown) by which the cone of the aerosol container is attached to the top of the container body. This latter engagement is such that the lower part can be rotated on the container, but usually, and as is assumed for the purposes of the following description, the actuator will be operated by the user between its operative and non-operative conditions by maintaining the lower part fixed in relation to the container, and rotating the upper part.

The top panel 34 of the lower part is centrally apertured at 40, and in the aperture 40 is located a radially extending, generally horizontal arm 42 which is integrally hinged to the skirt 20 for pivotal movement about a hinge line 44 lying beneath the nozzle 28. For that purpose the skirt is freed from the outer end of the arm along vertical slits 45. At its inner end, on the central axis of the actuator, the arm carries a downwardly projecting boss 46 arranged at its free end to engage over and make sealing contact with the valve stem 80 (FIG. 3) of the aerosol container when the actuator is fitted to the container. The boss 46 and arm 42 are formed with connecting passages 48, 49 for product flow from the valve stem to the nozzle, and it will be understood that downward pivoting movement of the arm about the hinge line 44 will therefore operate the aerosol valve by means of the valve stem, and so cause aerosol product to be dispensed from the nozzle. For ease of understanding the hinge line 44 is represented in the drawings by a broken line; however, it is to be understood that it may not be visible to the observer.

In addition to the boss 46, the inner free end of the arm 42 carries an upstanding tailpiece 50. When, as shown in FIG. 1, the actuator is in its operative condition, the top edge 52 of this tailpiece engages the bottom edge of the cross-piece 54 of a T-section structure 56 which is formed on the underside of the actuating member 22. The actuating member is accordingly held in its raised position by the aerosol valve of the container 12 through the agency of the arm 42.

The actuating member 22 has a downwardly depending peripheral wall 58 at which it is hinged to a complementary but shallow wall 60 of the upper part around the aperture 23. The connection between the walls 58, 60 is made by a pair of integral and aligned torsion bridges 62 adjacent the front end of the actuating member.

The actuating member is moulded in its depressed position so that these bridges resilently bias it downwards onto the tailpiece beneath. The effective spring rate of the bridges is, however, insufficient for the actuating member to actuate the aerosol valve by itself.

When, as shown in FIG. 2, the actuator is in one of its non-operative conditions, the actuating member is free to adopt its depressed, flush position under the bias of the bridges 62. The tailpiece 50 is then accommodated in the acute angle formed by the wall 58 of the actuator member at the appropriate one of its barbs 25. In order to raise the actuating member by rotation of the upper part to its operative condition, a pair of profiled ramps 64—(one for each non-operative condition)—are moulded on the top panel 34 of the lower part 16 and engageable at their top edges 72 by the leg 66 of the T-section structure 56 previously mentioned. The ramps 64 are mirror images of one another on either side of a vertical slot 68 which separates their adjacent end edges 70 and which is wide enough to receive the leg 66. The upper edges rise progressively but gently from the top panel 34 in the direction of the slot 68, reach their maximum height at approximately 50 of arc from the centre of the slot, and from there fall sharply to their respective end edges 70. The gently and steeply inclined edge portions and the summits of the ramps are respectively denoted by the reference numerals 72A, 72B and 72C in FIG. 4 of the drawings.

The depth of the T-section structure 56 axially of the actuator is such that, when the upper part 14 of the actuator is turned to its operative condition from one of its non-operative conditions, the leg 66 rides up the appropriate ramp 64 and so is caused to lift the actuator member 22, by pivotal movement on the torsion bridges 62, sufficiently to allow the cross-piece 54 to move over the tailpiece 50 in readiness for a dispensing operation. When the actuating member is properly aligned with the nozzle 28, the leg 66 is free to move down the slot 68 and the actuating member can be depressed for dispensing product. Slight misalignment of the actuator member is corrected by rotation of the upper part 14 to the aligned position, caused by cam action of the leg 66 with the steeply sloping part 72B of the appropriate ramp 64 when pressure is applied to the actuating member. In a similar way, pressure on the actuator member when the leg 66 is in engagement with the gently sloping part 72A of a ramp 64 will tend to rotate the upper part to the appropriate non-operative position. Thus, in a stack of the containers subject to vibration, e.g. during transit, any actuator member which is partially raised bcause the upper part is not properly turned to a non-operative condition will tend to be progressively and advantageously flattened by the weight of any containers above it, so reducing the risk of damage.

The non-operative conditions of the actuator correspond to the remote ends of the ramps 64. The leg 66 is then bottomed on the panel 34 to prevent depression of the actuating member. Rotational movement of the upper part beyond these positions is prevented by engagement of the tailpiece 50 behind the barbs 25 of the actuating member. In an alternative arrangement (not shown) the peripheral wall 58 of the actuating member is cut away sufficiently to clear the tailpiece 50, and the two non-operative positions of the actuator are defined by the respective separate engagements of two posts on lower part 16 with an abutment which projects inwardly from the skirt 18 of the upper part 14 adjacent the tip of the actuating member. The posts are moulded to project upwardly from the bed 32 at the appropriate angular positions.

Figure 10:
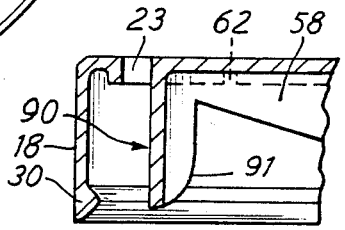
FIG. 10 shows part of the view of FIG. 7 in relation to a modification of the embodiment of FIGS. 1 to 9.

FIG. 10 shows a modification of the actuator in which the peripheral wall 58 of the actuating member is extended downwardly at the top of the actuating member to form a post 90 of V-shaped cross-section which is located forward of the torsion bridges 62. The arms of the post at its free bottom end form rounded edges 91 which are shaped for camming engagement with the ramp 64 on the respective side of the arm 42. Therefore, when the actuator is being operated to one or the other of its non-operative positions as described above, the post 90 co-operates with the appropriate ramp 42 to force the actuating member 22 positively towards its depressed position by pivotal movement about the bridges 62. The torsion bridges themselves are therefore no longer relied upon for preforming this function.

I claim:

1. An actuator for an aerosol container, which comprises an upper part having an an actuating member with a first engageable surface and a lower part having an arm member, a second engageable surface and an outlet, said upper and lower parts being rotatable between a first, operative position and a second, inoperative position, in the operative position the actuating member being movable and effective to actuate the arm member which operably engages a valve of said container to which the actuator including said arm member is fitted and thereby cause aerosol product to issue from the outlet, and in the inoperative position the actuating member being inoperative to actuate the arm member and thereby cause dispensing, wherein, upon rotation of the upper and lower parts from said inoperative position to said operative position, the actuating member is moved from a depressed position to a raised position respectively by cam action of said engageable surfaces whereby the actuating member when in said raised and said operative position becomes moveable and effective to actuate the arm member, and upon rotation of the upper and lower parts from said operative to said inoperative position, the actuating member is moved from said raised to said depressed position respectively whereby the actuating member becomes inoperative to move the arm member.

2. An actuator member according to claim 1, wherein the first engageable surface has a first abutment surface which is presented to a second abutment surface of the said second engageable surface for engagement therewith during rotation of the actuator, the actuating member being freed from the abutment surface when the actuator is moved from its operative position towards its inoperative position.

3. An actuator according to claim 2, wherein said second abutment surface is a contoured ramp surface.

4. An actuator according to claim 3, wherein the ramp surface rises from a flat panel which the first abutment surface engages to prevent depression of the actuating member in the inoperative position of the actuator.

5. An actuator according to claim 1, which has two said inoperative positions one in each direction of rotation from the operative position, and symmetrically disposed in relation thereto.

6. An acutator according to claim 5, wherein the inoperative position has limiting means to limit rotational positions of the actuator between which the opeative position is symmetrically situated.

7. An actuator according to claim 3, which has two said ramp surfaces symmetrically disposed on either side of a slot corresponding to the operative position of the actuator, the surfaces lying on a circular locus in relation to an axis of rotation of the upper and lower parts in relation to one another, and the first abutment surface of the actuating member being provided by a radially extending elongate portion which moves down said slot upon actuation of the actuating member.

8. An actuator as claimed in claim 7, wherein the first abutment surface further comprises a cross-piece formed as a leg of a T-section portion of the actuating member.

9. An actuator as claimed in claim 1, wherein the upper part is a one-piece moulding from thermoplastics material, the actuator member being pivotally and integrally attached by a pair of aligned torsion bridges, the upper part being mounded with the actuating member in its depressed position so as to be biased by the torsion bridges to that position.

10. An actuator according to claim 1, wherein the actuator member is pivotally mounted on the upper part by a pivotal connection located part way along its length, the said first engageable surface of the actuating member being provided by a downwardly depending post located forward of the pivotal connection, and the said second engageable surface of the lower part of the actuator being a contoured ramp surface.

* * * * *